US011812793B2

(12) United States Patent
Laucella et al.

(10) Patent No.: US 11,812,793 B2
(45) Date of Patent: Nov. 14, 2023

(54) CONTAINER FOR ELECTRONIC SMOKING ARTICLES

(71) Applicants: Ralph Laucella, Huntington, NY (US); Kirk Delucia, Smithtown, NY (US)

(72) Inventors: Ralph Laucella, Huntington, NY (US); Kirk Delucia, Smithtown, NY (US)

( * ) Notice: Subject to any disclaimer, the term of this patent is extended or adjusted under 35 U.S.C. 154(b) by 135 days.

(21) Appl. No.: 17/386,271

(22) Filed: Jul. 27, 2021

(65) Prior Publication Data

US 2022/0015417 A1 Jan. 20, 2022

Related U.S. Application Data

(63) Continuation of application No. 16/370,134, filed on Mar. 29, 2019, now Pat. No. 11,071,321.

(60) Provisional application No. 62/650,732, filed on Mar. 30, 2018.

(51) Int. Cl.

| | |
|---|---|
| ***A24F 9/16*** | (2006.01) |
| ***A24F 13/14*** | (2006.01) |
| ***B65D 25/10*** | (2006.01) |
| ***A24F 15/01*** | (2020.01) |
| ***B65D 83/00*** | (2006.01) |
| ***B65D 85/10*** | (2006.01) |
| ***B65D 45/32*** | (2006.01) |
| ***B65D 50/04*** | (2006.01) |
| *B65D 43/12* | (2006.01) |

(52) U.S. Cl.

CPC ..... *A24F 9/16* (2013.01); *A24F 13/14* (2013.01); *A24F 15/01* (2020.01); *B65D 25/10* (2013.01); *B65D 45/32* (2013.01); *B65D 50/046* (2013.01); *B65D 83/0011* (2013.01); *B65D 43/12* (2013.01); *B65D 85/10* (2013.01)

(58) Field of Classification Search

CPC .. A24F 9/16; A24F 15/01; A24F 13/14; A24F 15/00; B65D 85/10; B65D 43/12; B65D 83/0011; B65D 50/046; B65D 45/325; B65D 45/32; B65D 25/10

USPC ..... 206/270, 266, 265, 250, 255, 259, 242; 131/329, 175, 187, 190, 240.1, 241, 131/242.5, 347, 360, 250

See application file for complete search history.

(56) References Cited

U.S. PATENT DOCUMENTS

| | | | | |
|---|---|---|---|---|
| 2,491,958 A * | 12/1949 | Dunn | ..... | A24F 15/18 131/250 |
| 5,472,001 A | 12/1995 | Nicholson | | |
| 8,539,959 B1 * | 9/2013 | Scatterday | ..... | A24F 40/40 131/194 |

(Continued)

FOREIGN PATENT DOCUMENTS

| | | |
|---|---|---|
| CA | 2886292 A1 | 4/2014 |
| EP | 3202271 A1 | 8/2017 |

(Continued)

OTHER PUBLICATIONS

PCT Search Report and Written Opinion issued in corresponding PCT Application No. PCT/US19/24964 dated Jun. 20, 2019, 47 pages.

*Primary Examiner* — Rafael A Ortiz

(74) *Attorney, Agent, or Firm* — WEBER ROSSELLI & CANNON LLP

(57) ABSTRACT

The present disclosure relates to lockable and unlockable containers for electronic smoking articles, the containers including at least two concentric tubes, a locking mechanism retained therein, and an organizer configured to hold the articles.

18 Claims, 9 Drawing Sheets

(56) References Cited

U.S. PATENT DOCUMENTS

| | | | | |
|---|---|---|---|---|
| 8,584,842 | B2 * | 11/2013 | Fakhouri | A24F 15/18 206/256 |
| 8,967,382 | B2 | 3/2015 | Liu | |
| 2013/0025608 | A1 | 1/2013 | Fakhouri et al. | |
| 2013/0255702 | A1 * | 10/2013 | Griffith, Jr. | A24F 15/01 131/328 |
| 2013/0341218 | A1 | 12/2013 | Liu | |
| 2014/0020697 | A1 | 1/2014 | Liu | |
| 2014/0060555 | A1 * | 3/2014 | Chang | A24F 40/40 128/202.21 |
| 2014/0130797 | A1 | 5/2014 | Liu | |
| 2015/0008150 | A1 | 1/2015 | Liu | |
| 2015/0101944 | A1 | 4/2015 | Li et al. | |
| 2015/0122277 | A1 * | 5/2015 | Frobisher | A24D 1/00 131/338 |
| 2016/0050976 | A1 * | 2/2016 | Righetti | A24B 15/167 206/265 |
| 2016/0143357 | A1 * | 5/2016 | Liu | H02J 7/0045 392/394 |
| 2018/0110259 | A1 | 4/2018 | Kartashov | |

FOREIGN PATENT DOCUMENTS

| | | | | |
|---|---|---|---|---|
| KR | 101122749 | B1 | 3/2012 | |
| WO | 0156411 | A1 | 8/2001 | |
| WO | WO-2014195687 | A1 * | 12/2014 | A24F 15/12 |
| WO | 2016075028 | A1 | 5/2016 | |

* cited by examiner

CONTAINER FOR ELECTRONIC SMOKING ARTICLES

CROSS-REFERENCE

The present application is a continuation of U.S. patent application Ser. No. 16/370,134 filed Mar. 29, 2019, which claims priority to and the benefit of U.S. Provisional Application Ser. No. 62/650,732 filed on Mar. 30, 2018, the entire contents of which is incorporated herein by reference.

BACKGROUND

The present disclosure relates to containers for electronic smoking articles and, more particularly, to selectively lockable and releasable containers for electronic smoking articles.

Technical Field

In recent years substitutes for smoking products have increased in popularity. One particularly popular substitute is the electronic smoking article, e.g., "e-cig." Electronic smoking articles are able to provide the mouthfeel and breathing sensations associated with smoking articles while managing delivery of chemicals to a user. Typically, a user will purchase a pack of electronic smoking articles in a carrying container much like a traditional cigarette pack or, other, sometimes cumbersome carrying case. Traditional cigarette packing has disadvantages as the electronic smoking articles may be prone to breakage or the possibility of getting wet. Moreover, certain types of smoking articles require more secure containers to avoid tampering by small children.

Thus, there is a need to provide a container for electronic smoking articles that not only carries a plurality of smoking articles but also secures the smoking articles in a safe, tamper proof and child resistant manner.

SUMMARY

The present disclosure relates to a container or carrying case for electronic smoking articles. Each design is intended to be an eco-friendly modular design so that the components could be connected to cardboard or other eco-friendly components as needed in order to minimize the amount of plastic needed for the design to function. Several embodiments are shown and described.

The present disclosure relates to lockable and unlockable containers including at least two concentric tubes and a locking mechanism retained therein.

In some embodiments, the container for smoking articles is a pull and turn container which includes a first inner tube, a second outer tube, a locking mechanism extending beyond a proximal end of the first inner tube, and an organizer configured to hold or receive the smoking articles longitudinally within the container. The first inner tube defines a first cavity configured to receive one or more of the smoking articles, the first inner tube having a base member at or near a distal end thereof. The second outer tube defines a second cavity configured to slidingly encapsulate the first tube, the second tube having a cap at or near a proximal end thereof. The cap includes a cap orifice defined therethrough and a cap channel defined therein.

In some embodiments, the locking mechanism is disposed within and extends from the first inner tube. The locking mechanism may include a biasing member secured on the base member and a rotatable key extending therefrom. The rotatable key may include a threaded shaft having a handle on a proximal end thereof and a locking member positioned between the handle and the threads. The locking member has a profile configured to complimentarily match the profile of the cap channel when oriented in an aligned orientation and abut the cap channel when engaged in a locked configuration. The handle has a profile configured to complimentarily match the cap orifice when oriented in an aligned orientation. The threaded shaft runs through a shaft aperture positioned centrally on the organizer, the shaft aperture includes one or more teeth configured to engage the threads on the shaft. The organizer includes a generally planar shelf which surrounds the threaded shaft and extends generally perpendicular to the threaded shaft. Rotation of the key causes the threads to turn driving the teeth, including the organizer, distally or proximally along the shaft while maintaining the organizer generally perpendicular to the shaft.

In some embodiments, the base member is positioned on a distal ledge of the first inner tube. In some embodiments, the base member includes a centered base orifice. In some embodiments, the cap is positioned on a proximal ledge of the second inner tube.

In some embodiments, the biasing member includes an outer ring defining an outer periphery of the biasing member and a plurality of triangular biasing tabs extending inwardly from the outer ring. In some embodiments, the biasing tabs extend distally from a proximal end of the outer ring creating an acute angle between the biasing tabs and a base sidewall. In some embodiments, the biasing member further includes a central biasing aperture from which the threaded shaft extends through. In some embodiments, the key further comprises a retainer button secured on a distal end of the threaded shaft and secured between the base member and the biasing tabs.

In some embodiments, the locking member extends generally perpendicular from the longitudinal axis of the shaft. The longitudinal axis is indicated by the dashed line shown running through the container in some of the figures. In some embodiments, the locking member is removably secured within the cap channel on an outer surface of a top wall of the cap and generally visible from outside the container. In some embodiments, the locking member is removably secured within the cap channel defined within a thickness of the cap and generally hidden from sight from outside the container.

In some embodiments, the organizer further includes an outer sidewall positioned on an outer edge of the shelf and including a plurality of stabilizers positioned intermittently around the outer sidewall between the outer sidewall of the organizer and the inner surface of the first inner tube to increase friction between the organizer and the first inner tube. In some embodiments, the organizer is movable within the first cavity. In some embodiments, the organizer can be raised on the shaft beyond the proximal end of the first inner tube. In some embodiments, the organizer includes legs extending from the shelf in a fixed position.

In some embodiments, the container may be in a closed position, wherein the key extends through the cap orifice and beyond the second outer tube in a locked orientation wherein with the locking member is secured within the cap channel and prevented from being rotated.

In some embodiments, the container may be opened from the closed position, wherein the key is pulled against the bias of the biasing member and rotated from the locked orientation to an aligned orientation wherein the profile of the key compliments the profile of the cap orifice and allows the first tube to be released from the second tube to expose the smoking articles for presentation as the organizer moves along the shaft when the key is further rotated.

In some embodiments, the container for smoking articles is a pinch container which includes a first inner tube, a second outer tube, a locking mechanism extending beyond a proximal end of the first inner tube, and an organizer configured to hold or receive the smoking articles longitudinally within the container. The first inner tube defining a first cavity configured to receive one or more smoking articles, the first inner tube having a base member at a distal end thereof. The second outer tube defines a second cavity configured to slidingly encapsulate the first tube, the second tube having a cap at a proximal end thereof including a cap orifice defined therethrough. The locking mechanism is disposed within the first inner tube and includes a rotatable key extending from the base member, the rotatable key including a threaded shaft having a biasing handle on a proximal end thereof. The biasing handle includes a pair of biasing paddles angled away from each other and configured to transition between an expanded configuration wherein the paddles are spaced apart at a proximal end thereof and a narrowed configuration wherein the paddles are pressed or pinched together. The handle in the narrow configuration has a profile configured to complimentarily match the cap orifice when oriented in an aligned orientation. The handle in the expanded configuration has a profile which is greater than the cap orifice and abuts the cap orifice when the container is locked or closed. The threaded shaft runs through a shaft aperture positioned centrally on the organizer, the shaft aperture includes one or more teeth configured to engage the threads on the shaft. The organizer includes a generally planar shelf which surrounds the threaded shaft and extends generally perpendicular to the threaded shaft. Rotation of the key causes the threads to turn driving the teeth, including the organizer, distally or proximally along the shaft while maintaining the organizer generally perpendicular to the shaft.

In some embodiments, the pinch container includes a biasing handle which only needs to be pinched to open the container. In some embodiments, the pinch container may be a pinch and turn container which includes a rotatable biasing handle which is pinched to open the container and rotated to assist with the removal of the articles.

In some embodiments, the biasing paddles include at least one ridge creating a lip on a face of each paddle, wherein the lip abuts an outer surface of the cap immediately surrounding the cap orifice when the container is locked or closed. In some embodiments, the container may be in a closed position, wherein the key extends through the cap orifice and beyond the second outer tube in a locked orientation with the biasing tabs secured within the cap orifice in the expanded configuration and prevented from being rotated.

In some embodiments, the container may be in the open position, wherein the paddles are separated from each other and free of the cap orifice so that the smoking articles are exposed within the first inner tube for presentation. In order to close the container, the cap orifice is slid over the paddles thereby forcing or pinching the paddles closer together as the cap and the second outer tube are slid distally over the first inner tube. The bias of the paddles to move away from each other forces the paddles against the cap orifice and the lips prevent the cap orifice from sliding proximally thereby locking the two tubes together closing the container.

In some embodiments, the container for smoking articles is a press and turn container which includes a first inner tube, a second outer tube, a locking mechanism including a locking sleeve and a rotatable and depressible cap, and an organizer configured to hold or receive the smoking articles longitudinally within the container. The first inner tube defines a first cavity configured to receive one or more smoking articles. The first inner tube has a base member at a distal end thereof and the locking sleeve secured on a proximal end thereof. The locking sleeve include a series of locking tabs extending inwardly into the first cavity. The second outer tube defines a second cavity configured to slidingly encapsulate the first tube. The second tube has a rotatable and depressible cap at or near a proximal end thereof secured by a retaining ring. The rotatable cap includes a cap sidewall offset from an outer edge of the rotatable cap and extending distally therefrom into the second cavity creating a space between the inner surface of the second outer tube and the cap sidewall. The cap sidewall includes a series of grooved tabs complimentary in profile to the locking tabs. The retaining ring includes an annular ring configured to wrap around the cap sidewall and a plurality of biasing arms extending proximally at an acute angle from the annular ring, wherein at least a portion of the retaining ring is positioned within the space between the outer edge of the rotatable cap and the proximal end of the locking sleeve. A stationary organizer is secured within the first cavity and includes one or more shelf apertures configured to receive the smoking article. The organizer includes one or more legs configured to space the organizer from the base member.

DETAILED DESCRIPTION

The various embodiments disclosed herein each serve as a child resistant or tamper proof container or carry case for smoking articles. Each of the containers described herein include at least two concentric tubes, a first inner tube that is selectively received within a second outer tube and a locking mechanism which remains with the container. In some embodiments, the locking mechanism utilizes a unique pull and turn key. In some embodiments, the locking mechanism utilizes a unique key having tabs which must be pinched to release the two concentric tubes. In some embodiments, the locking mechanism utilizes a unique push and turn cap which remains with the second outer tube of the container.

Figure 1A:
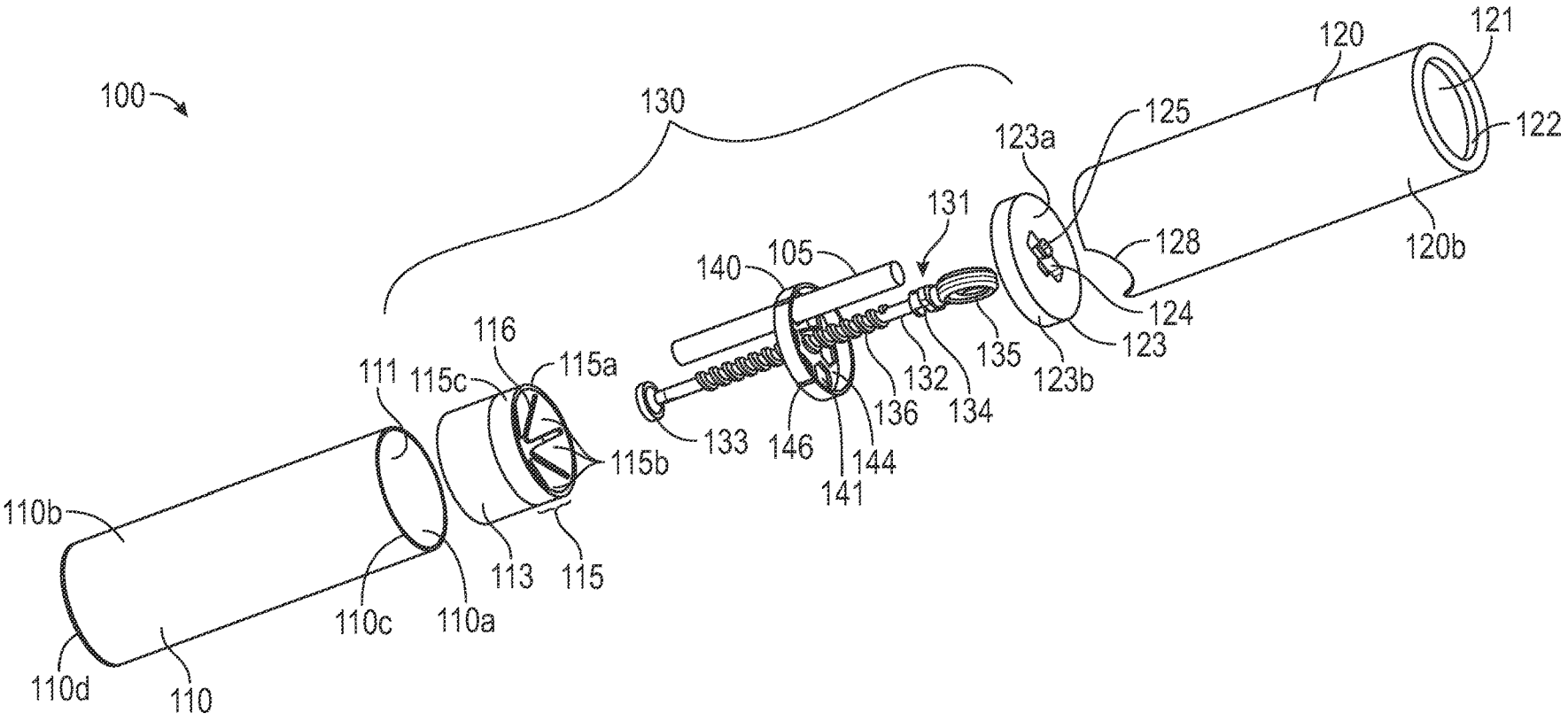
FIG. 1A is an exploded view of a container as described in at least one embodiment herein.
Figure 1B:
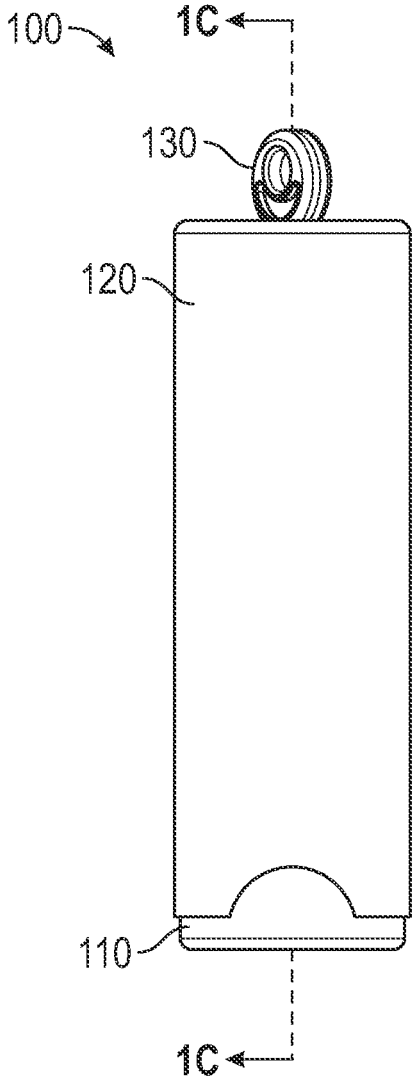
FIG. 1B is a side view of the container of FIG. 1A as described in at least one embodiment herein.
Figure 1C:
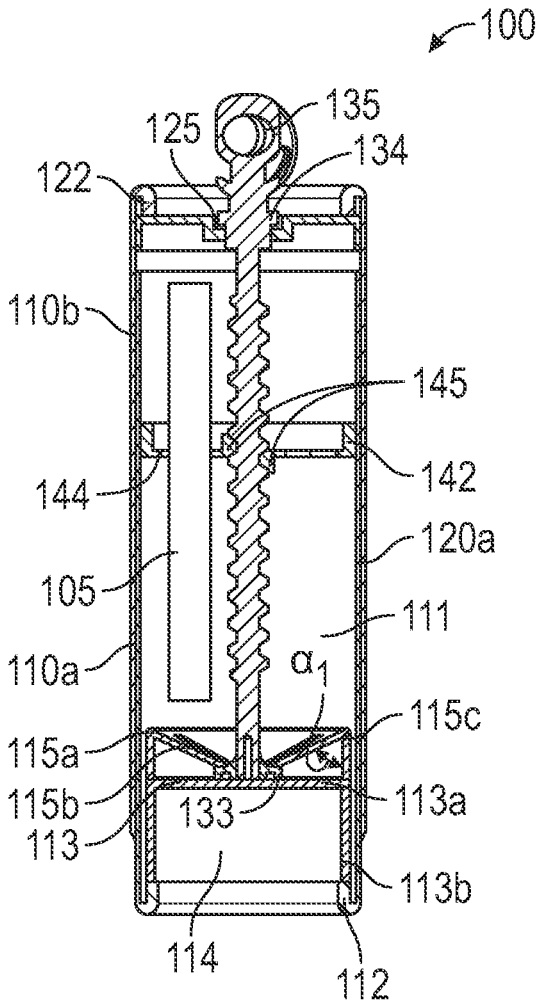
FIG. 1C is a cross-sectional view of the container of FIG. 1B as described in at least one embodiment herein.

Referring to FIGS. 1A-1C, a container or carry case 100 for electronic smoking articles 105 is shown in accordance with at least one embodiment of the present application. The container 100 is a pull and turn container including two concentric tubes, a first inner tube 110 that is selectively received within a second outer tube 120, and a locking mechanism 130 which includes a pull and turn key 131. The first inner tube 110 and the second outer tube 120 each include an inner surface 110*a*, 120*a*, respectively, and an outer surface 110*b*, 120*b*, respectively. The first inner tube 110 and the second outer tube 120 are slidingly removable, in a telescoping manner, from each other. The outer surface 110*b* of the first inner tube 110 bears against the inner surface 120*a* of the second outer tube 120. The first and second tubes 110, 120 come together to form a closed container (FIGS. 1B-1C) and can be slid completely apart from one another to form an open container.

The first inner tube 110 of container 100 defines a first cavity 111 configured to receive and/or store the one or more electronic smoking articles 105. In some embodiments, the first cavity may also be configured to receive the locking mechanism 130, and particularly a rotatable key 131. As shown, an open proximal end 110*c* of the first inner tube 110 is configured to allow the one or more electronic smoking articles to be added to or removed from the first inner tube 110, and an opposite closed distal end 110*d* of the first inner tube 110 is closed by base member 113. The base member includes at least a top wall 113*a* which spans the opening of the first cavity 111 to close completely or substantially the distal end 110*d* of the first tube 110. In some embodiments, the base member 113 and the inner tube 110 form a unitary one-piece structure. In some embodiments, as shown, the base member 113 is a separate piece from the first tube 110 and is secured to a distal ledge 112 at or near the distal end 110*d* of the first tube 110. The distal ledge 112 narrows the opening of the first cavity 111 and acts as a stop by preventing the base member 113, as well as the biasing member 115, from passing completely through the first cavity 111 from the proximal end 110*c* to the distal end 100*d* of the first tube 110.

In some embodiments, the base member 113 also includes one or more base sidewalls 113*b* extending distally from the top wall 113*a* along the longitudinal axis of the container. The base sidewall 113*b* is configured to space the top wall 113*a* of the base member 113 from the distal end 110*d* of the first tube, and particularly the distal ledge 112, thereby creating a distal recess 114 in the distal end 110*d* of the first inner tube 110. The base member 113, and particularly the base sidewall 113*b*, is secured or held captive at or near the distal end 110*d* of the first inner tube 110, and particularly the distal ledge 112, using any suitable method including threading, snap-fitting, glues, frictional engagement, male/female engagement, and the like. In some embodiments, the base member 113, and particularly the base sidewall 113*b*, are held captive by glue.

The second outer tube 120 of container 100 defines a second cavity 121 configured to receive at least the open proximal end 110*c* of the first inner tube 110. In some embodiments, a majority of the first inner tube 110, including the smoking articles 105 and the locking mechanism 130 positioned therein, are received within the second cavity 121 of the second tube 120. As shown, the distal end 120*d* of the second outer tube 120 is open and the opposite proximal end 120*c* of the second outer tube 120 is closed by the cap 123. The cap 123 includes at least a top cap wall 123*a* which spans the opening of the second cavity 121 to close a majority of the proximal end 120*c* of the second tube 120. In some embodiments, the cap 123 and the outer tube 120 form a unitary one-piece structure. In some embodiments, as shown, the cap 123 is a separate piece from the second tube 120. The cap 123, and specifically an outer perimeter of the outer surface of the top cap wall 123*a*, is secured to a proximal ledge 122 at or near the proximal end 120*c* of the second tube 120. The proximal ledge 122 narrows the opening of the second cavity 121 and acts as a stop by preventing the cap 123 from passing completely through the second cavity 121 from the distal end 120*d* to the proximal end 120*c* of the second tube 120. The cap 123 is secured to the proximal ledge 122 and/or a portion of one or more sidewalls 120*b* on the distal end 120*d* of the second outer tube 120 using any suitable method including threading, snap-fitting, adhesives, and the like. In some embodiments, the cap 123 is held captive in a proximal end 120*c* of the second tube 120 by glue.

In some embodiments, the cap 123 includes one or more cap sidewalls 123*b* having a length along the second cavity 121 which defines a thickness of the cap 123. In some embodiments, the cap 123 further includes a cap orifice 124 defined completely through a thickness of the cap 123 and a cap channel 125 positioned on an outer surface of the top cap wall 123*a*. The cap channel 125 is defined through only a top portion of the thickness the cap 123.

As also shown in FIGS. 1A-1C, in some embodiments, the container 100 includes a locking mechanism 130 secured inside the first cavity 111 of the first inner tube 110. The locking mechanism 130 of the container 100 includes a biasing member 115 secured to a rotatable key 131, the rotatable key 131 including at least a shaft 132, a retainer button 133, a locking member 134, a handle 135, and threads 136. The rotatable key 131 being spaced from the inner surface 110*a* of the first inner tube 110 and generally centered within the first cavity 111. In some embodiments, as shown, the rotatable key 131 is of one-piece construction.

The biasing member 115, e.g., a spring, is shown seated on top of the base member 113. The base member 113 and the biasing member 115 are held captive at or near the distal end 110*d* of the first inner tube 110. In some embodiments, the base member 113 and the biasing member 115 are secured to each other and the first inner tube 110 at or near the distal end 110*d* of the first inner tube 110 using any suitable method including threading, snap-fitting, adhesives, and the like. In particular embodiments, the base member 113 and the biasing member 105 are held captive using an adhesive or glue.

As further shown in FIGS. 1A-1C, in some embodiments, the biasing member 115 includes an outer ring 115*a* defining an outer periphery of the biasing member 115 with a series of biasing tabs 115*b* protruding inwardly therefrom, e.g. generally triangular-shaped tabs. One or more sidewalls 115*c* may also extend longitudinally from the outer ring 115*a* to define a thickness of the biasing member. The series of biasing tabs 115*b* being connected to each other near or at the outer ring 115*a* and separated from each other in a central portion of the biasing member 115 creating a generally centered aperture 116 in the biasing member 115. The aperture 116 in the biasing member 115 being configured to receive a distal end of the key 131. In some embodiments, as depicted, a portion of the biasing member 115, and specifically the series of biasing tabs 115*b*, also extend in a distal direction towards the base member 113 from a proximal portion of the outer ring 115*a* and at an acute angle $\alpha_1$ relative to the sidewalls 115*c* of the biasing member 115. The biasing tabs 115*b* have a natural bias or tension in a distal direction thereby forcing the key 131 in a distal direction.

As further shown in FIGS. 1A-1C, in some embodiments, the rotatable key 131 includes a shaft 132 connected on a distal end thereof to a retainer button 133. The shaft 132 is also connected on a proximal end thereof to a handle 135. The shaft 132 further includes threads 136 positioned between the retainer button 133 and the handle 135, in particular along a central portion of the shaft 132. One or more locking members 134 are also positioned on the shaft 132 between the threads 136 and the handle 135.

In some embodiments, the retainer button 133 is sandwiched between the top wall 113*a* of the base member 113 and the biasing tabs 115*b* of the biasing member 115. The retainer button 133 is larger in area and/or circumference (e.g., outer perimeter of any shape button) than the aperture 116 of the biasing member 115, such that the retainer button 133 cannot pass through the aperture 116 of the biasing member 115 when the key 131 is pulled on and/or rotated. The retainer button 133, in some embodiments, may also be free of the base member 113 and the biasing member 115 thereby allowing the key 131 to freely rotate in either a clockwise or counterclockwise direction without causing the base member 113, the biasing member 115, and/or the first inner tube 110 to rotate as well. In some embodiments, the retainer button 133 is spaced from the threads 136 of the key 131 on a distal end of the shaft 132.

As further shown in FIGS. 1A-1C, in some embodiments, the shaft 132 of the key 131 extends from the retainer button 133 through aperture 116 of biasing member 115 along a length of the first inner tube 110 and extends beyond the proximal end 110*a* of first inner tube 110. The shaft 132 is generally centered on the base member 113 within the first cavity 111 of the first inner tube 110. The handle 135 is positioned on a proximal end of the shaft 132. In some embodiments, the handle 135 is spaced from the threads 136 of the key 131 on a proximal end of the shaft 132.

In some embodiments, the key 131, and specifically the handle 135, is configured to protrude through the cap orifice 124, which is complimentary in configuration to the handle 135. The proximal end of the key 131, and particularly the handle 135, includes one or more locking members 134. In some embodiments, the one or more locking members 134 are positioned on the shaft 132 between the handle 135 and threads 136. In some embodiments, the one or more locking members 134 extend from the shaft 132 in a generally perpendicular manner relative to the longitudinal axis of the shaft 132. The one or more locking members 134 are configured to be received within the cap channel 125 defined on the top outer surface of the top cap wall 123*a*. The cap channel 125 includes a configuration that is complimentary to the configuration of the locking members 134. For example, in some embodiments, the locking members 134 generally define a rectangular shape configured to be received and locked into a complimentary rectangular shaped cap channel 125 defined on an outer surface 123*a* of the cap 123. It is envisioned that the locking members 134, as well as the cap channel 125, may define any suitable configuration including but not limited to, square, circular, triangular, heptagonal, hexagonal, octagonal, s-shaped, t-shaped, x-shaped, c-shaped, and the like.

As can be best seen in FIG. 1C, in some embodiments, the locking member 134 sits within the cap channel 125 on the outer surface of the top cap wall 123*a* such that the locking member 134 can be seen from outside the closed container 100. By the biasing member 115, and particularly the biasing tabs 115*b*, applying a force or tension in a distal direction to the retainer button 133 and shaft 132, the locking member 134 is forced distally against the cap channel 125 on the outer surface of the top cap wall 123*a* thereby locking the first and second tubes 110, 120 together in a closed position. In a closed position, the first and second cavities 111, 121 of the first and second tubes 110, 120 are not accessible.

As further shown in FIGS. 1A and 1C, a portion of the cap channel 125 and a portion of the cap orifice 124 overlap each other. In some embodiments, the cap channel 125 and the cap orifice 124 in combination define a generally t-shaped or x-shaped configuration.

As still further shown in FIGS. 1A-1C, in some embodiments, the handle 135 is generally defined as a round or circular configuration including a hole 137. It is envisioned that the handle 135, as well as the cap orifice 124, may define any suitable configuration including but not limited to, square, circular, triangular, heptagonal, hexagonal, octagonal, s-shaped, t-shaped, x-shaped, c-shaped, and the like.

Figure 2A:
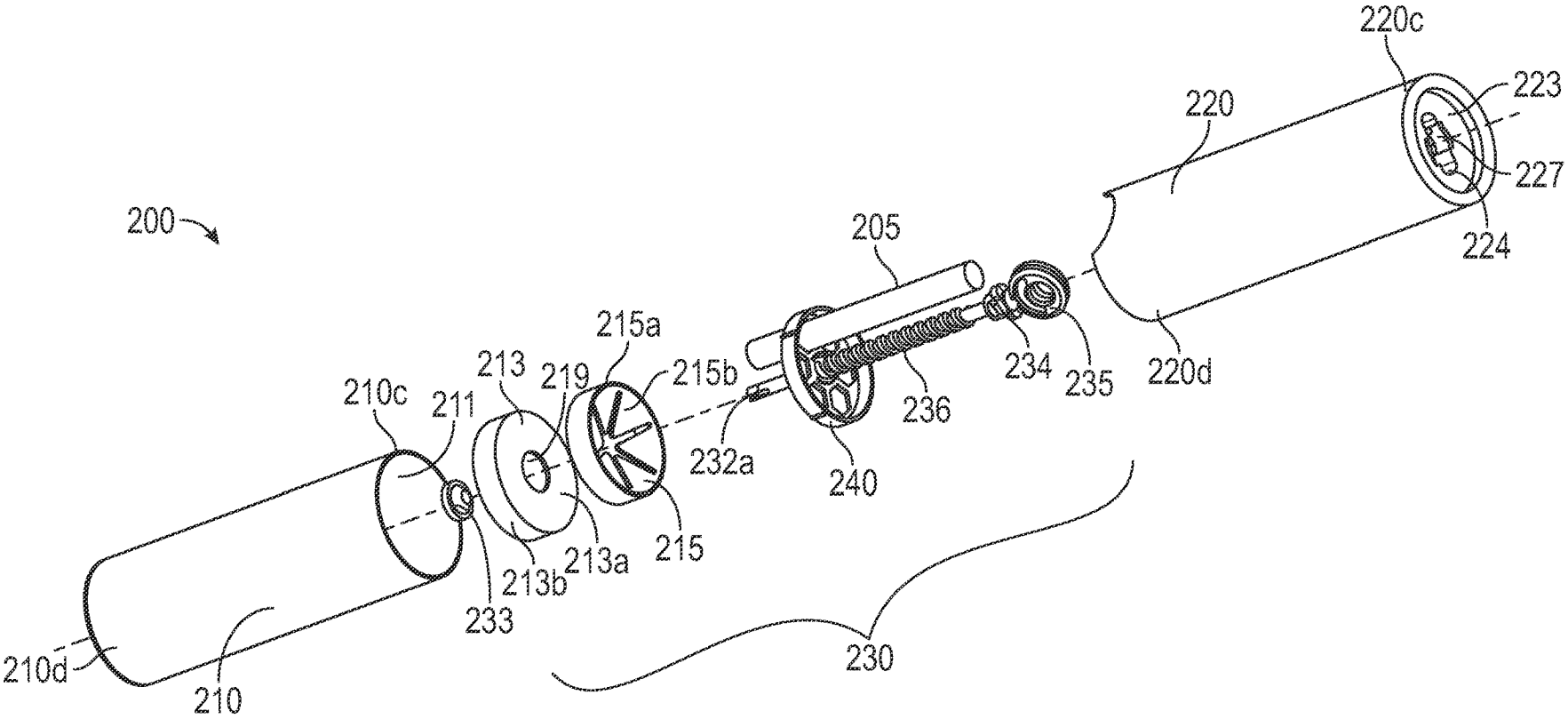
FIG. 2A is an exploded view of a container as described in at least one embodiment herein.

In some embodiments, the handle 135 and the locking member 134 extend from the shaft 132 in a manner wherein the handle 135 and the locking member 134 are vertically aligned on the shaft 132 (FIGS. 1A and 2A). In some embodiments, the handle 135 and the locking member 134 extend from the shaft 132 in a manner wherein the handle and the locking member 134 are not vertically aligned.

In addition to the two concentric tubes 110, 120 and the locking mechanism 130, the containers described herein may also include at least one organizer 140 configured to receive and/or store the smoking articles 105 inside the first cavity 111 of the container 100. As shown, in some embodiments, the organizer 140 includes a shelf 144 including one or more shelf apertures 141 defined therethrough. Each shelf aperture 141 being spaced from another to create space between the smoking articles when received therein. The one or more shelf apertures 141 being configured to maintain the smoking articles 105 in a snug manner such that the smoking articles 105 are forced to move with the organizer 140 as the organizer is raised (moved proximally), lowered (moved distally), or rotated on the threads 136 of the shaft 132 of the key 131. In some embodiments, each smoking article 105 is frictionally fit into a shelf aperture 141 while remaining removable from the organizer 140 when sufficient force is applied to free the smoking article 105 from the shelf aperture 141.

As shown in FIG. 1C, in some embodiments, the organizer 140 may further include an outer wall 142 generally surrounding the outer perimeter of the shelf 144, one or more stabilizers 146, and/or a central shelf orifice 143 in which the threaded shaft 132 of the key 131 passes through. As shown in cross-section, the shelf orifice 143 of the organizer 140 includes at least one tooth or teeth 145 positioned on and complimentary to the threads 136 of the shaft 132. To raise or lower the organizer 140 inside the first cavity 111, the key 131 can be rotated causing the threads 136 of shaft 132 to move or rotate which in turn causes the organizer 140 to be raised or lowered by the teeth 145 positioned on the threads 136.

The stabilizers 146 extend from the outer wall 142 towards the first tube 110 to increase friction between the organizer 140 and the first tube 110. This increased friction helps cause the organizer 140 to raise and lower when the key 131 is rotated by preventing the organizer 140 from spinning freely.

To open or unlock the container 100, the distal end of the first inner tube 110 and/or the distal end of the second outer tube 120 can be held while the key 131, and particularly the handle 135 of the key 131, is pulled away from the second outer tube 120 with enough force to dislodge the locking member 134 from the cap channel 125 on the cap 123. The key 131 is then turned as needed to vertically align the locking member 134 and/or the handle 135 (simultaneously or sequentially) with the cap orifice 124 allowing the cap 123, including the rest of the second, outer tube 120, to slide over the locking member 134 and the handle 135 to expose the internal components therein, e.g., the smoking articles 105. With the second outer tube 120 removed and the key 131 remaining secured inside the first cavity 111 of the first inner tube 110, the key 131 can be turned or rotated to raise or lower the organizer 140 as needed. Since the smoking articles are friction fit in the shelf apertures 141 of the organizer 140, the raising or lowering of the organizer 140 cause the smoking articles 105 to similarly raise or lower.

As can be seen in FIG. 1B, in some embodiments, the second outer tube 120 includes at least one cut-out 128 on a distal end 120*d* thereof to expose a larger surface area of the outer surface 110*b* of the distal end 11*od* of the first inner tube 110 for better gripping. In some embodiments, the second outer tube 120 includes two cut-outs 128 on a distal end 120*d* thereof. In some embodiments, the two cut-outs 128 are positioned on opposing sides of the second outer tube 120. In some embodiments, the outer surface 110*b* of the first inner tube 110 includes a texture or micro-texture to further increase surface area in the area of the one or more cut-outs 128 to further enhance gripping of the first inner tube 110 during the opening or closing of the container 100.

Figure 2B:
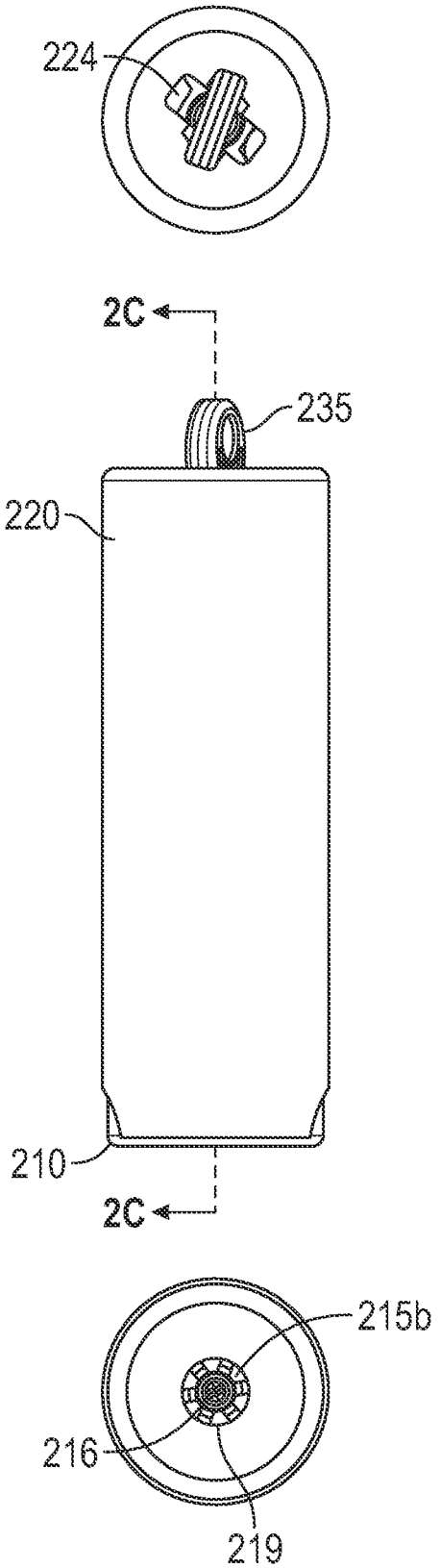
FIG. 2B includes a top view, side view, and bottom view of the container of FIG. 2A as described in at least one embodiment herein.
Figure 2C:
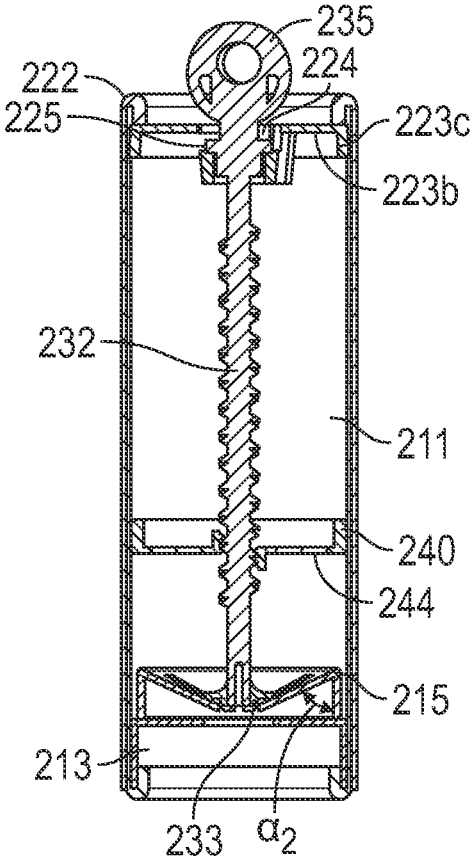
FIG. 2C is a cross-sectional view of the container of FIG. 2B as described in at least one embodiment herein.

Turning now to FIGS. 2A-2C, a pull and turn container 200 is depicted including two concentric tubes, a first inner tube 210 that is selectively received within a second outer tube 220, and a locking mechanism 230 which includes a pull and turn key 231.

The first inner tube 210 of container 200 defines a first cavity 211 configured to receive and/or store the one or more electronic smoking articles 205. As shown, an open proximal end 210*c* of the first inner tube 210 is configured to allow the one or more electronic smoking articles 205 to be added to or removed from the first inner tube 210. The base member 213 includes a top base wall 213*a* spanning most of the opening defined by the first cavity 211 and including a generally centered base orifice 219 defined therethrough. The base member 213 also includes a base sidewall 213*b*. In some embodiments, the first inner tube 210 and the base member 213 may be formed as one-piece. In some embodiments, the first inner tube 210 and the base member 213 may be formed as separate pieces wherein the base member 213 is secured to a distal ledge 212 at or near a distal end 210*d* the first tube 210 using any suitable method including threading, snap-fitting, adhesives, and the like.

The second outer tube 220 of container 200 defines a second cavity 221 configured to receive at least the proximal end 210*c* of the first inner tube 210 including at least a portion of the first cavity 211 and the smoking articles 205 and locking mechanism 230 positioned within the first cavity 211. As shown, a proximal end 220*c* of the second outer tube 220 includes a proximal ledge 222 which narrows the second cavity 221 at the proximal end 210*c* of second outer tube 220 and an open distal end 220*d* of the second outer tube 220 is configured to receive the proximal end 210*c* of the first inner tube 210. The cap 223, and specifically an outer perimeter of a top surface 223*a* of the cap 223, is seated on the proximal ledge 222 inside the second cavity 221. In some embodiments, the second tube 220, the proximal ledge 222, and the cap 223 may be formed as one-piece. In some embodiments, the second tube 220, the proximal ledge 222, and the cap 223 may be formed as separate pieces. The cap 223 is secured to the second tube 220 or the proximal ledge 222 using any suitable method including threading, snap-fitting, adhesives, and the like. In some embodiments, the cap 223 is held captive at or near a proximal end 220*c* of the second tube by adhesive.

In some embodiments, the cap 223 includes a cap orifice 224 defined completely through a thickness of the cap 223. In addition, in some embodiments, the cap 223 further includes a cap channel 225 positioned below the top wall 223*a* of the cap 223 thereby being hidden from outside the container 200. In some embodiments, the cap channel is defined within the thickness of the cap 223. In some embodiments, the cap channel 225 extends from an inner surface 223*b* of the top wall 223*a* into the second cavity 221.

As shown in FIGS. 2A-2C, the container 200 includes a locking mechanism 230 secured inside the first cavity 211 of the first inner tube 210, The locking mechanism 230 of the container 200 includes a biasing member 215 secured to a rotatable key 231, the rotatable key 231 including at least a shaft 232, a retainer button 233, a locking member 234, a handle 235, and threads 236. The rotatable key 231 being spaced from the sidewalls of the first inner tube 210 and generally centered within the first cavity 211. In some embodiments, as shown, the rotatable key 231 is constructed of multiple pieces. For example, the distal end of the shaft 232 includes prongs 232*a* configured to snap-fit into or be inserted into retainer button 233 to form the rotatable key 231.

The biasing member 215, e.g., a spring, is shown seated on top of the base member 213. The base member 213 and the biasing member 215 are held captive at or near the distal end 210*d* of the first inner tube 210. In some embodiments, the base member 213 and the biasing member 215 are secured to each other and the first inner tube 210 at or near the distal end 410*d* of the first inner tube 210 using any suitable method including threading, snap-fitting, adhesives, and the like.

As further shown in FIGS. 2A-2C, in some embodiments, the biasing member 215 includes an annular ring 215*a* defining an outer perimeter of the biasing member 215 with a series of biasing tabs 215*b* protruding inwardly therefrom, e.g. generally triangular-shaped tabs. The series of tabs 215*b* being connected near or at the outer periphery of the annular ring 215*a* and separated from each other in a central portion of the biasing member creating a generally centered aperture 216 in the biasing member 215. The aperture 216 in the biasing member 215 being configured to receive a distal end of the key 231. In some embodiments, as depicted, the biasing member 215, and specifically the series of biasing tabs 215*b*, also extend(s) in a distal direction towards the base member 213 from a proximal portion of the annular ring 215*a* and at an acute angle $\alpha_2$ relative to the sidewalls 215*c* of the biasing member 215 thereby creating a natural bias or tension in a distal direction.

As further shown in FIGS. 2A-2C, in some embodiments, the rotatable key 231 includes a shaft 232 connected on a distal end thereof to a retainer button 233. The shaft 232 is also connected on a proximal end thereof to a handle 235. The shaft 232 also includes threads 236 on at least a central portion thereof, and further includes one or more locking members 234 positioned between the threads 236 and the handle 235. In some embodiments, the retainer button 233 is held captive between the top wall 213*a* of the base member 213 and the tabs 233 of the biasing member 215. In some embodiments, the retainer button 133 is spaced from top wall 213*a*. The retainer button 233 is larger in area and/or circumference (e.g., outer perimeter of any shape button) than aperture 216 of the biasing member 215, such that retainer button 233 cannot pass through the aperture 216 of the biasing member 215 when the key 231 is pulled on and/or rotated. In some embodiments, the retainer button 233 is spaced from the threads 236 of the key 231 on a distal end of the shaft 232.

As further shown in FIGS. 2A-2C, in some embodiments, the shaft 232 of the key 231 extends from the retainer button 233 through aperture 216 of biasing member 215 along a length of the first inner tube 210 and extends beyond the proximal end of first inner tube 210. The shaft 232 is spaced from the sidewall(s) 210*b* of the first inner tube 210 and is generally centered over the base member 213. The handle 235 is positioned on a proximal end of the shaft 232. In some embodiments, the handle 235 is spaced from the threads 236 of the key 231 on a proximal end of the shaft 232.

The key 231, and specifically the handle 235, is configured to protrude through a complimentary cap orifice 224 defined within the cap 223 of the second outer tube 220. The proximal end of the key 231 includes one or more locking members 234. In some embodiments, the one or more locking members 234 are positioned on the shaft 232 between the handle 235 and threads 236. In some embodiments, the one or more locking members 234 extend from the shaft 232 in a generally perpendicular manner relative to the length of the shaft 232 and are configured to be received within a cap channel 225 which includes a configuration that is complimentary to the configuration of the locking members 234. For example, in some embodiments, the locking members 234 generally define a rectangular shape configured to be received and locked into a complimentary rectangular shaped cap channel 225 defined on an inner surface 223*b* of the cap 223. It is envisioned that the locking members 234, as well as the cap channel 225, may define any suitable configuration including but not limited to, square, circular, triangular, heptagonal, hexagonal, octagonal, s-shaped, t-shaped, x-shaped, c-shaped, and the like.

As can be best seen in FIG. 2C, in some embodiments, the cap channel 225 can be defined as a recess formed on the inner surface 223*b* of the cap 223 such that the locking member 234 sits within the cap channel 225 on the underside of the cap 223. In such embodiments, the locking member 234 is hidden from sight from outside the closed container 200. By the biasing member 215, and particularly the biasing tabs 215*b*, applying force or tension in a distal direction to the retainer button 233 and shaft 232, the locking member 234 positioned in the cap channel 225 draws the top wall 223*a* of the cap 223, along with the proximal end 220*c* of the second tube 220, towards the distal end 210*d* of the first inner tube 210 thereby locking the first and second tubes 210, 220 together in a closed position. In a closed position, the first and second cavities 211, 221 of the first and second tubes 210, 220 are not accessible.

As further shown in FIGS. 2A and 2C, a portion of the cap channel 225 is vertically aligned over a portion of the cap orifice 224. The cap orifice 224 extends completely through the cap 223. The cap channel 225 forms a recess beneath the cap 223.

As still further shown in FIGS. 2A-2C, in some embodiments, the handle 235 is generally defined as an annular shape including a hole. In some embodiments, the hole in the handle 235 is configured to receive a separate connecting member, e.g., a string, rope, chain, elastic band, lanyard, display post, chord, and the like, for connecting or hanging the containers described herein from the connecting member for display or carrying purposes. The connecting member can be removably attached to the handle. It is envisioned that the handle 235, as well as the cap orifice 224, may define any suitable configuration including but not limited to, square, circular, triangular, heptagonal, hexagonal, octagonal, s-shaped, t-shaped, x-shaped, c-shaped, and the like.

The container 200 also includes at least one organizer 240 configured to receive and/or store the smoking articles 205. The organizer 240 includes a shelf 244 including one or more apertures 241 defined therethrough. The one or more shelf apertures 241 configured to maintain the smoking articles 205 in a snug manner such that the smoking articles 205 are forced to move with the organizer 240 as the organizer 240 is raised (moved proximally) or lowered (moved distally) on the threads 236 of the shaft 232 of the key 231. Each smoking article 205 is frictionally fit into a shelf aperture 241 while remaining removable when sufficient force is applied to free the smoking article 205 from the shelf aperture 241.

To unlock or open container 200, the distal end 210*d* of the first inner tube 210 and/or the distal end 220*d* of the second outer tube 220 can be held while the key 231 is pulled proximally and turned, as needed, to free the locking member 234 from the cap channel 225 beneath the cap 223. Then the key 231 or handle 235 may be further turned, as needed, to vertically align the locking member 234 and/or the handle 235 (simultaneously or sequentially) with the cap orifice 224 allowing the cap 223, including the rest of the second, outer tube 220, to slide over the locking member 234 and the handle 235 to expose the internal components within the first inner tube 210, e.g., the smoking articles 205. With the second outer tube 220 removed and the key 231 remaining secured inside the first cavity 211, the key 231 can be turned or rotated to raise or lower the organizer 240 including the smoking articles 205, as needed. Rotation of the key 231 causes the threads 236 to move thereby driving the teeth, including the organizer 240, distally or proximally along the shaft 232 while maintaining the organizer 240, and particularly the shelf 244, generally perpendicular to the shaft 232.

Figure 3A:
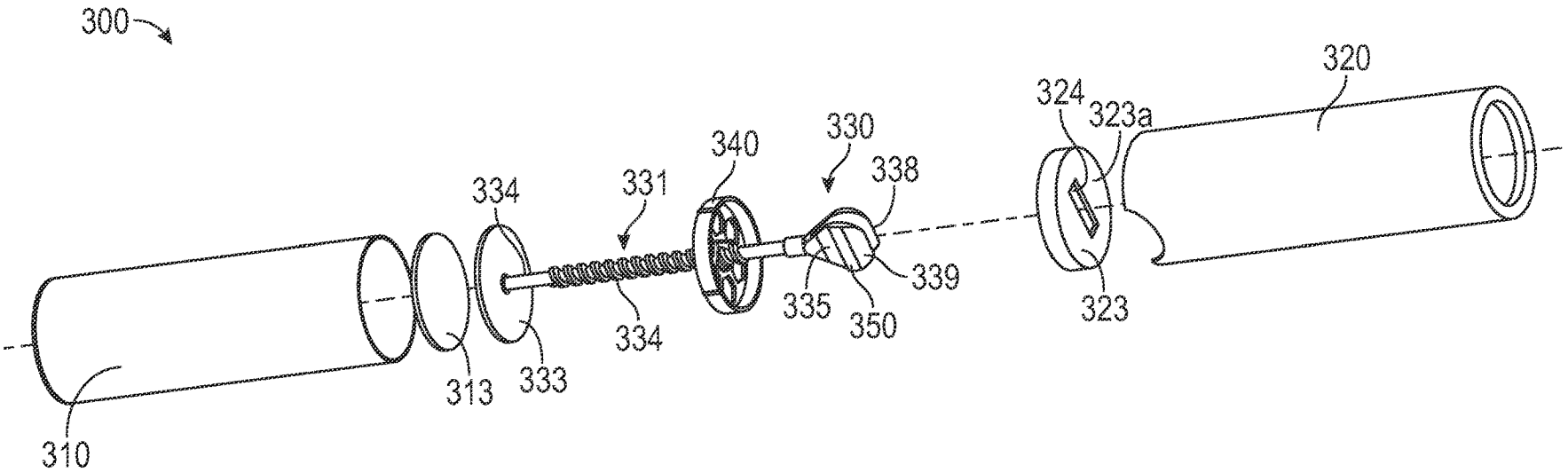
FIG. 3A is an exploded view of a container as described in at least one embodiment herein.
Figure 3B:
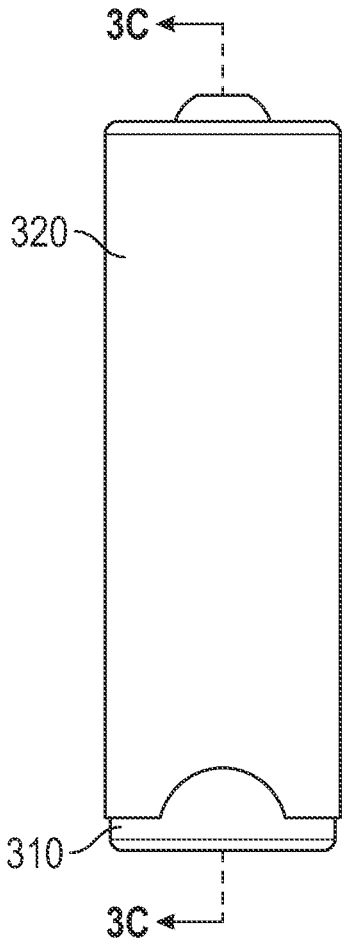
FIG. 3B is a side view of the container of FIG. 3A as described in at least one embodiment herein.
Figure 3C:
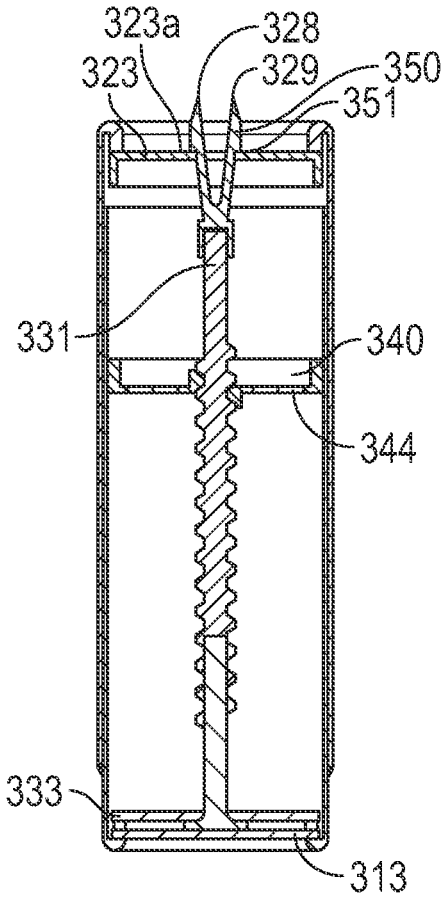
FIG. 3C is a cross-sectional view of the container of FIG. 3B as described in at least one embodiment herein.

Turning now to FIGS. 3A-3C, a pinch container 300 is depicted including two concentric tubes, a first, inner tube 310 that is selectively received within a second, outer tube 320 that includes a cap 323. The locking mechanism 330 utilizes a key 331 having a biased handle 335 including two paddles 338, 339 which must be pinched together with enough force to allow the key 331 to pass through a cap orifice 324 defined within the cap 323 of the second tube 320. More particularly, the key 331 includes two opposing paddles 338, 339 that are biased relative to one another, and particularly biased to move away from each other. The distal ends of the two paddles 338, 339 are joined to each other and positioned on the proximal end of the threaded shaft 334 of the key 331. The proximal ends of the two paddles 338, 339 are separated from each by a greatest distance there between. The distance between the two paddles 338, 339 gradually decreases from the proximal end to the distal end of the paddles 338. 339. When pressed towards each other with enough force, the paddles 338, 339 are pinched closer to each other slimming the key's profile to match the profile of the cap orifice 324 defined within the cap 323. When pinched or in the slimmed profile, the cap orifice 324 is no longer restrained by the paddles 338, 339 and can be slid over the paddles 338, 339 to remove the second outer tube 320 from the first inner tube 310 thereby exposing the components (not shown) within the first cavity 311 of the first tube 310.

When located within the cap orifice 324, a top portion of the paddles 338, 339 extend beyond the cap orifice 324 and a bottom portion of the paddles 338, 339 extend below the cap orifice 324.

Each paddle 338, 339 is shown to include one or more ridges 350. Each ridge 350 creates a lip 351 on the paddle 338, 339. When the ridged paddles 338, 339 are positioned within and extend through the cap orifice 324, the lip 351 on the ridged paddles 338, 339 abuts against the outer surface 323*a* of the cap 323 along opposite edges of the cap orifice 324. In this position, the lips 351 prevent the cap 323 from passing over the paddles 338, 339 thereby locking the second outer tube 320 onto the first inner tube 310.

In some embodiments, the paddles 338, 339 may include a plurality of ridges 350 forming spaced lips 351. In such embodiments, the spacing of the lips may apply different amounts of pressure distally to the cap 323 and second tube 320. For example, in some embodiments, the lips positioned closest to the shaft may apply the least force to the cap as compared to the lips positioned farthest from the shaft which may apply the most force to the cap.

Although paddles 338, 339 are depicted as solid structures, e.g., without a hole defined therethrough, in some embodiments, one or more of the paddles 338, 339 may include an aperture defined therethrough, similar to the handles depicted and/or described herein.

Similar to the containers 100, 200 of FIGS. 1A-2C, the container 300 of FIGS. 3A-3C includes a generally flat base member 313, a centrally located key 331 including a retainer button 333, a threaded rotatable shaft 334, a handle 335 and a movable organizer 340 configured to receive and/or store smoking articles (not shown). As depicted, in some embodiments, the container 300 does not include a separate biasing member positioned on top of the base member 313. Rather, as depicted, in some embodiments, the retainer button 333 is secured directly to the base member 313 in a manner which allows the key 331 to freely rotate but not be pulled away from the base member 313. It should be noted that as described hereinabove with container 300, in some embodiments, a natural bias is incorporated into the handle 335, and particularly the paddles 338, 339, thereby providing a biasing member in the form of the biasing handle 335.

In still other embodiments, the container 300 may further include a second biasing member (not shown) positioned on top of the retainer button 333. The second biasing member being similar to the biasing members 115, 215 of FIGS. 1A-2C. The addition of the second biasing member will render the container 300, in some embodiments, a pinch and pull container wherein the key can be both pulled and pinched to initiate the opening of the container from a closed position.

To unlock the container 300, the first and/or second tube 310, 320 is held and the two opposing paddles 338, 339 are pinched with enough force to draw the paddles 338, 339 closer to each other to form a slimmer profile so that the cap orifice 324 can pass over the paddles 338, 339. By pinching the two paddles 338, 339, the lips 351 are removed from abutting against the outer surface 323*a* of the cap 323 along opposite edges of the cap orifice 324.

Figure 4A:
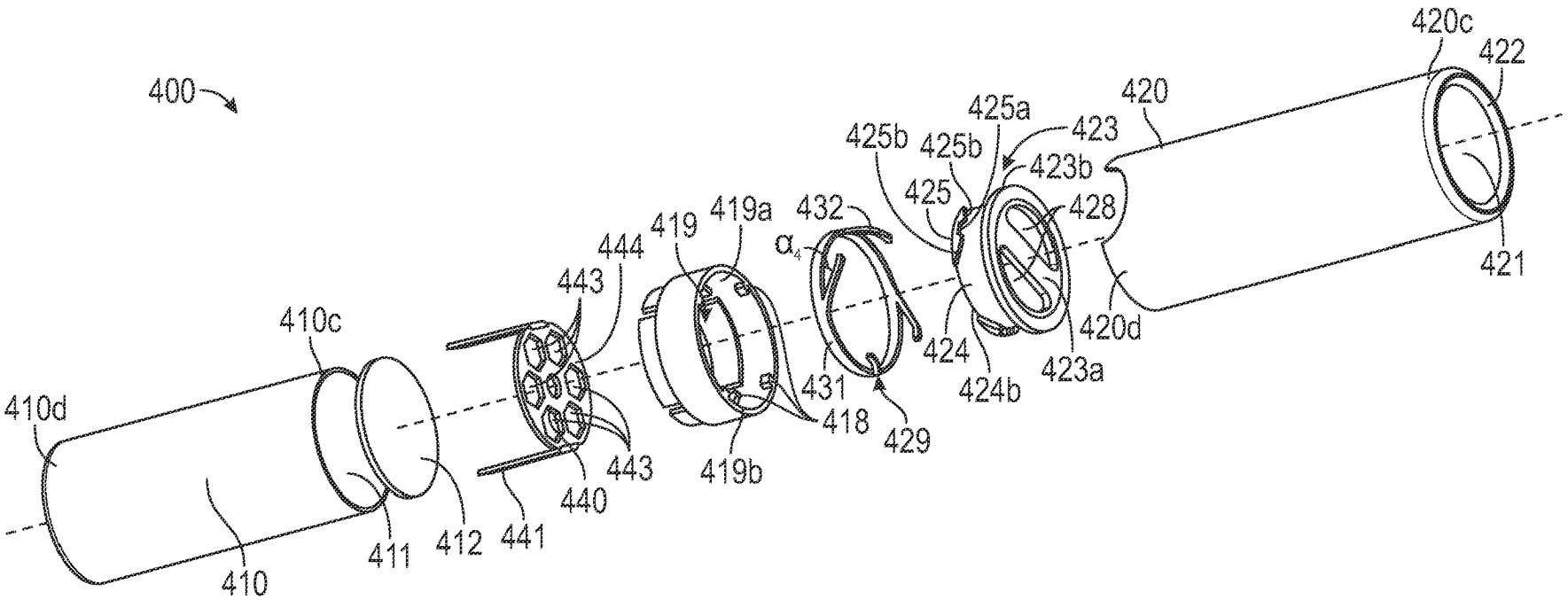
FIG. 4A is an exploded view of a container as described in at least one embodiment herein.
Figure 4B:
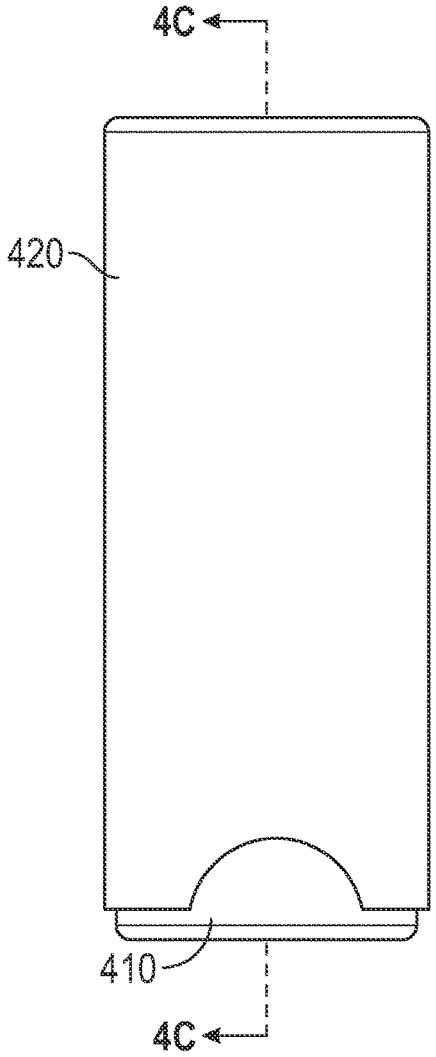
FIG. 4B is a side view of the container of FIG. 4A as described in at least one embodiment herein.
Figure 4C:
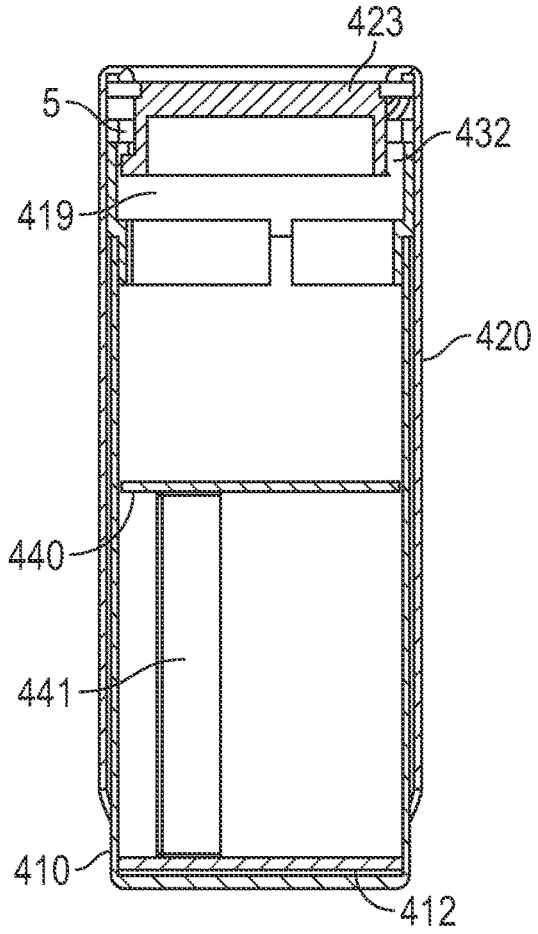
FIG. 4C is a cross-sectional view of the container of FIG. 4B as described in at least one embodiment herein.

Referring now to FIGS. 4A-4C, in some embodiments, the container 400 includes two concentric tubes, a first, inner tube 410 that is selectively received within a second, outer tube 420 that includes a cap 423. The first tube 410 includes a base member 412 secured at or near a distal end 410*d* thereof and a locking sleeve 419 secured on a proximal end 410*c* thereof. The base member 412 extends across the first cavity 411 of the first tube 410 to generally close the distal end 410*d* of the first tube 410. The locking sleeve 419 is secured to the proximal end 410*c* of the first tube 410 extending the first cavity 411 and without closing the proximal end 410*c* of the first tube 410. The locking sleeve 419 also includes one or more locking tabs 418 positioned around an inner periphery 419*a* of the locking sleeve 419. In some embodiments, the one or more locking tabs 418 extend inwardly into the cavity 411 from a proximal end 419*b* of the locking sleeve 419.

As further shown in FIGS. 4A-4C, the second outer tube 420 defines a second cavity 421 which is open on a distal end 420*d* thereof and closed on a proximal end 420*c* thereof by the cap 423 secured therein by a retaining ring 429. The cap 423 includes a top 423*a* which extends across the second cavity 421 of the second tube 410 to close the proximal end of the second tube 420. The cap 423 also includes a cap sidewall 424 which extends along a longitudinal axis of the second tube 420 and is offset from an outer edge 423*b* of the cap 423. By being offset from the outer edge 423*b* of the cap 423, a space 5 exists inside the second cavity 421 between the cap sidewall 424 and the second tube 420. The retaining ring 429 wraps around the cap sidewall 424 and is secured within the space 5 between the cap sidewall 424 and the second outer tube 420. Within the space 5, the retaining ring 429 also extends longitudinally between the outer edge 423*b* of the cap 423 and the proximal end 419*b* of the locking sleeve 419.

As shown in FIG. 4A, the cap sidewall 424 includes a series of grooved tabs 425 which are complimentary to the locking tabs 418 on the locking sleeve 419. The grooved tabs 425 can be positioned on a distal end 424*b* of the sidewall 424 and are configured to extend from the sidewall 424 towards the second tube 420. The grooved tabs 425 are configured to matingly engage the locking tabs 418 upon selective rotation thereof, e.g., the cap 423 locks to the locking sleeve 419 that is secured to the top (opening) rim of the first (inner) tube 410 to lock the container 400 closed. In some embodiments, the grooved tabs 425 may include a central groove 425*a* positioned between two beveled portions 425*b*, the beveled portions 425*b* configured to guide the locking tabs 418 to the central groove 425*a* during rotation of the cap 423 to ensure engagement. In some embodiments, the grooved tabs may include at least groove positioned next to at least one beveled portion. In still other embodiments, the grooved tab may be one continuous tab that surrounds the cap sidewall completely and includes a plurality of grooves spaced intermittently around the tab (not shown).

The retaining ring 429 includes an annular ring 431 which wraps around the sidewall 424 of the cap 423 and is secured within the space 5 between the outer edge 423*b* of the cap 423 and the proximal end 419*b* of the locking sleeve 419. One or more biasing arms 432 extend at an acute angle as from the annular ring 431 within the space 5. Each biasing arm 432 has a natural bias away from the annular ring 431. Once the annular ring 431 is secured in place, the biasing arm(s) 432 are configured to extend longitudinally away from the ring 431 thereby forcing the cap 423, and specifically the outer edge 423*b* of the cap 423, towards the proximal end 420*c* of the second tube 420, and particularly a proximal ledge 422. Each biasing arm 432 is also configured to collapse towards the annular ring 431 when a downward force is applied thereto. For example, pressing or pushing down on the cap 423 from outside the second tube 420 will cause the biasing arms 432 inside the tube 420 to move towards the annular ring 431 allowing the cap 423 to slide down into the second cavity 421 of the second tube 420.

To close or lock the container 400, the first tube 410 may be substantially encapsulated within the second tube 420 and the cap 423 forced or pressed downwardly (distally) and rotated until the locking grooves 425, and particularly the central groove 425*a*, on the distal end 424*b* of the cap sidewall 424 engage the locking tabs 418 of the locking sleeve 419 thereby locking the two tubes 410, 420 relative to one another securing the container 400 in a locked or closed position. Once the locking tabs 418 and the locking grooves 425 are engaged, the force applied (or pressing) can be decreased or stopped allowing the biasing arms 432 to naturally return to their initial extended position away from the annular ring 431 forcing the cap 431 to slide proximally away from the locking sleeve 419 and applying additional force to the engagement between the locking tabs 418 and locking grooves 425.

To open or unlock the container 400 of FIGS. 4A-4C, the second outer tube 420 is held and the cap 423 is pushed distally and rotated via cap recesses 428 to disengage the locking grooves 425 of the cap 425 from the locking tabs 418 of the locking sleeve 419 to release the two tubes 410, 420. Once the tabs 418 and grooves 425 are disengaged, the second tube 420 is free to slide over the first tube 410 to expose the internal components therein, e.g., the organizer 440 and smoking articles (not shown).

In some embodiments, the organizer 440 may be non-removable from the first inner tube 410. In some embodiments, the organizer 440 may be stationary or non-movable, either longitudinally or rotationally within the first inner tube 410. In some embodiments, the organizer 440 may be unable to be raised or lowered within the first tube 410. In some embodiments, the organizer 440 may be unable to be raised or lowered beyond the first tube 410.

As further shown, in some embodiments, the organizer 440 may include one or more legs 441 configured to space the organizer 440 from the base member 412. The organizer 440 still has a shelf 444 extending generally perpendicular to the longitudinal axis of the tube 410 and across the first cavity 411. The shelf 444 includes one or more shelf apertures 443 configured to receive and/or store the smoking articles along the longitudinal axis of the tube 410.

In some embodiments, a push and turn container such as container 400 may alternatively include a movable organizer positioned on a rotatable key as described herein. In some embodiments, the rotatable key of such a push and turn container would not extend beyond the proximal end of the first tube to avoid interfering with the depressible cap.

Figure 5:
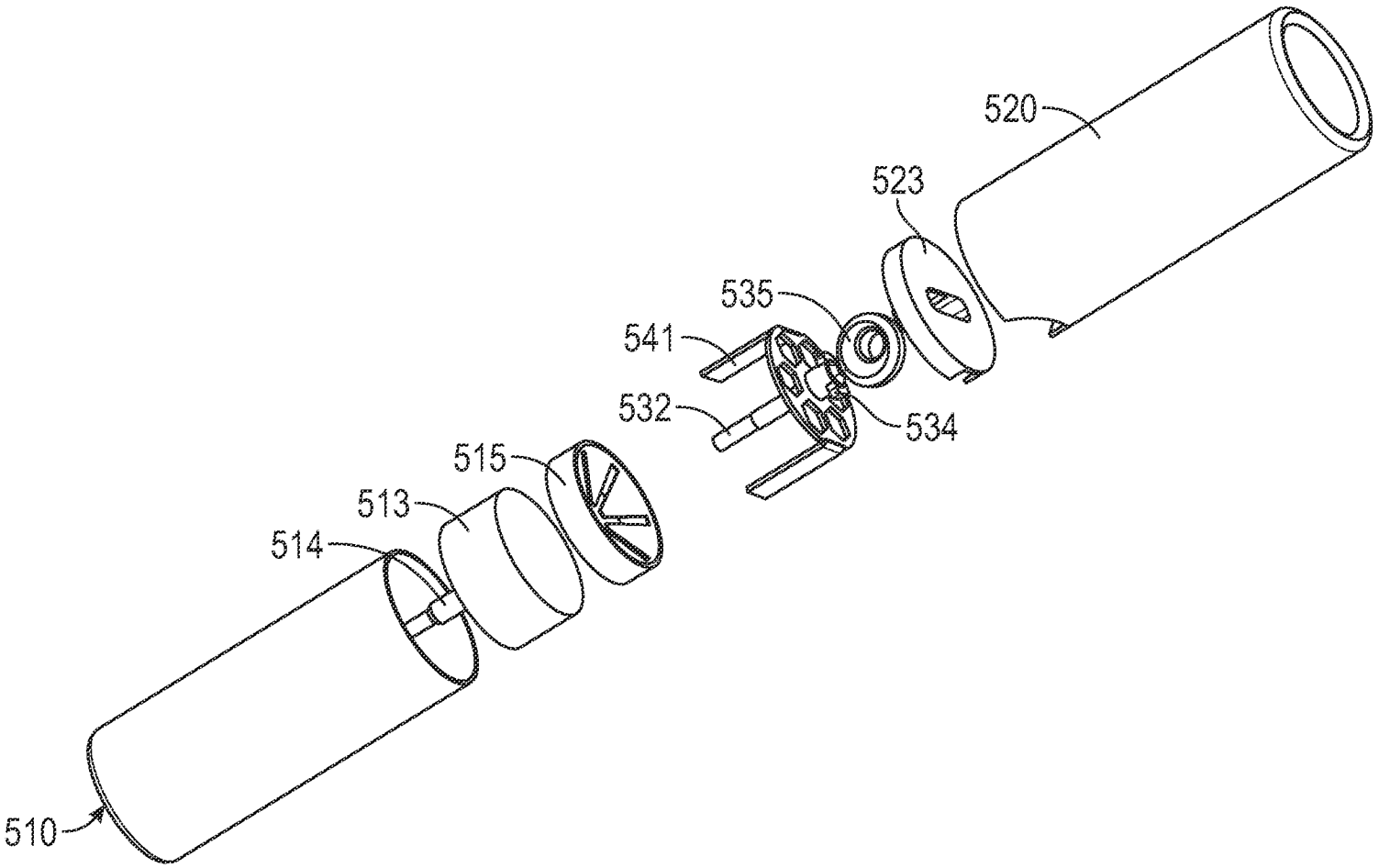
FIG. 5 is an exploded perspective view of a container as described in at least one embodiment herein.

Turning to FIG. 5, the container 500 depicted is a pull and turn container which includes two concentric tubes, a first, inner tube 510 configured to be selectively received within a second, outer tube 520 that includes a cap 523. As shown, in some embodiments, the shaft 532 is free of threads and extends from the handle 535, including locking member 534, on a proximal end thereof to the distal end of the first inner tube 510. The shaft 532, shown in two pieces but may be one or more pieces, extends through the organizer 541, the biasing member 515 and the biasing member holder 513. In some embodiments, the shaft may also include a retainer button (not seen) positioned between the biasing member and the holder. The holder 513 is free of a top wall such that biasing member 515 can be received and/or held captive within a cavity of the holder 513. The holder 513 also includes a distal stem 514 extending therefrom to which the shaft 532 will attach or pass through. The handle 535, and optionally the locking member 534, is configured to protrude through a complimentary orifice defined in the cap 523 of the second tube 520 and is locked against the cap 523 under the bias of the bias member 515 when offset from the orifice. The handle 535 and shaft 532 are free to rotate within the first tube 510 because it is not rotationally constrained at the bottom thereof. Since the shaft 532 is free of threads, rotation of the handle 535 does not cause the organizer 541 to raise or lower within the container.

To unlock the container, the first or second tube 510, 520 is held and the handle 535 is pulled with enough force to dislodge the locking member 534 from the cap 523. The handle 535 is then turned to align with the orifice and released allowing the second, outer tube 520 to slide over the handle 535 and locking member 534 to expose the internal components therein, e.g., the smoking articles. In some embodiments, the biasing member, e.g., spring, performs a dual function: provides a bias to secure the first and second tubes 510, 520 when the handle 535 is offset relative to the orifice in the cap 523; and provides a bias which forces one or both of the shaft 523 or the organizer 541 move proximally to present the smoking articles once opened.

It is envisioned that in any of the embodiments described herein, the container may include a key having a shaft which is thread free. For example, the paddles of FIG. 3A-3C may in some embodiments, include a shaft free of threads.

Each of the containers described herein may include inner and outer tubes of various shapes, e.g., cylindrical, rectangular, triangular or any other geometric configuration. In some embodiments the shapes of the inner and outer tubes are the same, such as circular. In some embodiments, the shapes of the inner and outer tubes are different, such as hexagonal outer tube and a circular inner tube.

Each of the containers described herein may be made from any suitable packaging material. Some examples include paper, cardboard, plastics, metal, alloys, wood, and combinations thereof. In some embodiments, the container is made of a plastic material. In some embodiments, the container is made of a cardboard material. In some embodiments, the container is made of a degradable material. In some embodiments, the container is made of nondegradable materials. In some embodiments, the container is made of both degradable and nondegradable materials.

Each of the containers described herein, in whole or in part, can be made using an suitable method including but not intended to be limited to, casting, extruding, molding, pressing, injection, and three-dimensional printing.

Each of the containers described herein include at least one biasing member. In some embodiments, the biasing member may form a bias in only one direction. In some embodiments, the biasing member may perform a dual function.

Any suitable biasing member may be used. The biasing member being configured to allow the key to be received within a portion thereof. Some non-limiting examples include a torsion spring, a living hinge, a diaphragm, a spring cone, and combinations thereof. In particular embodiments, the biasing member includes a plurality of triangular-shaped tabs extending inwardly and distally from an outer ring with a center opening therein for passage of the key.

In some embodiments, the biasing member may be configured to include a high enough spring constant to create a desired force to resist child tampering.

The smoking articles described herein are intended to include electronic smoking articles, such as vape pens or electronic cigarettes. Unlike traditional smoking implements, such as cigarettes or cigars, electronic smoking articles when damaged or dented may no longer function. The containers described herein safely store the electronic smoking articles in a manner which is spaced from the outer walls of the container, and optionally spaced from each other inside the package, thereby preventing the articles from being easily damaged or dented if the container is dropped or dented. The containers also maintain the electronic smoking articles in a child-resistant or child-proof manner.

It will be understood that various modifications may be made to the embodiments disclosed herein while remaining within the general scope of the containers described herein. Thus, those skilled in the art may envision other modifications within the scope and spirit of the claims.

What is claimed is:

1. A container for smoking articles, comprising:

a first inner tube defining a first cavity configured to receive one or more smoking articles, the first inner tube having a base member at a distal end thereof;

a second outer tube defining a second cavity configured to slidingly encapsulate the first tube, the second tube having a cap at a proximal end thereof including a cap orifice defined therein; and a locking mechanism disposed within the first inner tube and including:

a rotatable key extending from the base member, the rotatable key including a threaded shaft having a handle on a proximal end thereof, the handle including a pair of biasing paddles angled away from each other and configured to transition between an expanded configuration wherein the paddles are spaced apart and a narrowed configuration wherein the paddles are pinched together, the handle having a profile configured to complimentary match the cap orifice when oriented in an aligned orientation and abuts the cap orifice when engaged in a locked and expanded configuration; and an organizer positioned on the threaded shaft and including one or more shelf apertures configured to receive the smoking article, the organizer configured to be raised or lowered on the threaded shaft when the key is rotated.

2. The container of claim 1, wherein the biasing paddle includes at least one ridge creating a lip on the paddle, wherein the lip abuts an outer surface of the cap immediately surrounding the cap orifice.

3. The container of claim 1, wherein the container is in a closed position, the key extends through the cap and beyond the second outer tube in a locked orientation wherein with the biasing tabs are secured within the cap orifice in the expanded configuration and prevented from being rotated.

4. The container of claim 3, wherein to open the container in the closed position, the paddles are pinched together to allow the paddles to be passed through the cap orifice when the second outer tube is slid over the paddles to release the first tube from the second tube to expose the smoking articles for presentation as the organizer moves along the shaft when the key is further rotated.

5. The container of claim 1, wherein the base member is positioned on a distal ledge of the first inner tube.

6. The container of claim 1, wherein the cap is positioned on a proximal ledge of the second inner tube.

7. The container of claim 1, wherein the organizer includes a central shaft aperture including at least one tooth configured to be received within the thread of the threaded shaft.

8. The container of claim 1, wherein the organizer includes a shelf surrounding the threaded shaft and extending generally perpendicular to the longitudinal axis of the shaft, the shelf apertures defined completely through a thickness of the shelf thereby maintaining the smoking articles along the longitudinal axis of the container.

9. The container of claim 8, wherein the organizer further includes an outer sidewall positioned on an outer edge of the shelf and including a plurality of stabilizers positioned intermittently around the outer sidewall between the outer sidewall of the organizer and the inner surface of the first inner tube to increase friction between the organizer and the first inner tube.

10. The container of claim 1, wherein distal ends of the pair of biasing paddles are joined to each other and positioned on the proximal end of the threaded shaft of the key.

11. The container of claim 1, wherein proximal ends of the pair of biasing paddles are separated from each by a greatest distance therebetween.

12. The container of claim 1, wherein a top portion of the pair of biasing paddles extend beyond the cap orifice and a bottom portion of the pair of biasing paddles extend below the cap orifice, when the handle is located within the cap orifice.

13. The container of claim 1, wherein the pair of biasing paddles may include a plurality of ridges forming spaced lips.

14. The container of claim 13, wherein lips positioned closest to the shaft may apply the least force to the cap as compared to the lips positioned farthest from the shaft which may apply the most force to the cap.

15. The container of claim 1, wherein the key is not able to be pulled away from the base member.

16. The container of claim 1, wherein a retainer button is secured directly to the base member in a manner which allows the key to freely rotate.

17. The container of claim 1, wherein the paddles include a natural bias therebetween forming a biasing handle.

18. The container of claim 17, wherein the container may further comprise a second biasing member positioned on top of the retainer button rendering the container a pinch and pull container.

* * * * *